US006715218B2

(12) United States Patent
Johnson

(10) Patent No.: US 6,715,218 B2
(45) Date of Patent: Apr. 6, 2004

(54) UNIDIRECTIONAL SUPPORT DEVICE

(75) Inventor: Charles Paul Michael Johnson, Portland, OR (US)

(73) Assignee: adidas International B.V. (NL)

( * ) Notice: Subject to any disclaimer, the term of this patent is extended or adjusted under 35 U.S.C. 154(b) by 0 days.

(21) Appl. No.: 10/074,557

(22) Filed: Feb. 12, 2002

(65) Prior Publication Data

US 2003/0150136 A1 Aug. 14, 2003

(51) Int. Cl.[7] ..... A43B 7/20; A43B 7/14

(52) U.S. Cl. ..... 36/89; 36/88; 36/45; 602/27

(58) Field of Search ..... 36/88, 89, 92, 36/45, 71; 602/5, 9, 12, 27, 28, 60, 65

(56) References Cited

U.S. PATENT DOCUMENTS

| | | | | |
|---|---|---|---|---|
| 991,036 | A | * 5/1911 | Spiegelman | 36/89 |
| 1,586,698 | A | 6/1926 | Posner | |
| 2,302,694 | A | 11/1942 | Jennings | |
| 3,707,730 | A | 1/1973 | Slider | |
| 3,732,575 | A | 5/1973 | Pakulak | |
| 4,051,553 | A | 10/1977 | Howard | |
| 4,187,620 | A | * 2/1980 | Selner | 36/28 |
| 4,272,849 | A | 6/1981 | Thurston et al. | |
| 4,366,634 | A | 1/1983 | Giese et al. | |
| RE31,538 | E | 3/1984 | Antonious | |
| 4,524,464 | A | 6/1985 | Primiano et al. | |
| 4,561,122 | A | 12/1985 | Stanley et al. | |
| 4,565,195 | A | 1/1986 | Eisenberg | |
| 4,663,783 | A | 5/1987 | Obayashi | |
| 4,691,387 | A | 9/1987 | Lopez | |
| 4,698,851 | A | 10/1987 | Dunford et al. | |
| 4,738,447 | A | 4/1988 | Brown | |
| 4,742,579 | A | 5/1988 | Dunford | |
| 4,766,612 | A | 8/1988 | Patton, Sr. | |
| 4,776,111 | A | 10/1988 | Crowley | |
| 4,779,289 | A | 10/1988 | Prouty | |
| 4,787,376 | A | 11/1988 | Eisenberg | |
| 4,815,147 | A | 3/1989 | Gazzano et al. | |
| 4,864,659 | A | 9/1989 | Morris | |
| 4,865,023 | A | 9/1989 | Craythorne et al. | |
| 4,930,162 | A | 6/1990 | Côté | |
| 4,958,384 | A | 9/1990 | McCrane | |
| 4,995,119 | A | 2/1991 | Codkind | |
| 5,018,221 | A | 5/1991 | Romandetto | |

(List continued on next page.)

FOREIGN PATENT DOCUMENTS

| | | |
|---|---|---|
| DE | 35 16 545 A1 | 5/1985 |
| DE | 87 06 816.8 | 7/1987 |
| DE | 87 08 682.4 | 8/1987 |
| DE | 37 25 516 C2 | 9/1988 |
| DE | 37 38 005 A1 | 5/1989 |
| DE | 89 10 050.6 | 11/1989 |
| DE | 298 08 682 U1 | 9/1999 |
| DE | 100 10 403 A1 | 9/2001 |
| DE | 100 10 404 A1 | 9/2001 |
| HU | 24401/99 | 6/1999 |
| JP | 09262332 | 10/1997 |
| WO | WO 99/23981 | 5/1999 |
| WO | WO 00/53275 | 9/2000 |

OTHER PUBLICATIONS

Three photos of adidas, "Fingersave Glove".

*Primary Examiner*—M. D. Patterson
(74) *Attorney, Agent, or Firm*—Testa, Hurwitz & Thibeault, LLP

(57) ABSTRACT

Disclosed are unidirectional support devices and articles incorporating such devices. The devices are substantially flexible in one direction while substantially rigid in an opposing direction. The devices can be manufactured in essentially any shape or size and can be incorporated into a variety of articles of sports equipment, such as sport shoes, elbow braces, gloves, etc. The devices disclosed are typically made of polymeric materials, such as polyurethanes, silicones, polyethylenes, nylons, polyesters, and polyester elastomers, and combinations thereof.

19 Claims, 9 Drawing Sheets

U.S. PATENT DOCUMENTS 5,033,119 A 7/1991 Wiggins
5,050,319 A * 9/1991 Perotto et al. ..... 36/117.6
5,056,509 A 10/1991 Swearington
5,067,175 A 11/1991 Gold
5,078,128 A 1/1992 Grim et al.
5,083,314 A 1/1992 Andujar
D323,910 S 2/1992 Pierce, Jr.
5,107,544 A 4/1992 Capatosto
5,125,171 A 6/1992 Stewart
5,136,725 A 8/1992 Montero
5,152,082 A 10/1992 Culpepper
5,175,947 A 1/1993 Parracho
5,257,418 A 11/1993 Jaskiewicz
5,267,677 A 12/1993 Nash
5,295,269 A 3/1994 Ballard
5,307,521 A * 5/1994 Davis ..... 2/22
5,330,391 A 7/1994 Mitchell
5,358,469 A 10/1994 Patchel et al.
5,456,650 A 10/1995 Williams, Jr. et al.
5,486,157 A 1/1996 DiBenedetto
5,511,242 A 4/1996 Bianchi
5,511,243 A 4/1996 Hall et al.
5,551,083 A 9/1996 Goldsmith
5,557,803 A 9/1996 Granich et al.
5,628,069 A 5/1997 Ebert
5,640,712 A 6/1997 Hansen et al.
5,741,222 A 4/1998 Fiore
5,758,365 A 6/1998 Steeley
5,774,896 A 7/1998 Hochmuth
5,774,897 A 7/1998 Hochmuth
5,792,087 A 8/1998 Pringle
5,799,659 A 9/1998 Stano
5,802,614 A 9/1998 Melone, Jr.
5,809,571 A 9/1998 Spitzer
5,810,754 A 9/1998 Kenosh
5,815,838 A 10/1998 Lord et al.
5,848,440 A 12/1998 Pajorola
5,881,385 A 3/1999 Hochmuth
5,884,329 A 3/1999 Goldsmith et al.
5,894,684 A * 4/1999 Sand et al. ..... 36/117.1
5,896,683 A 4/1999 Foxen et al.
5,933,868 A 8/1999 Bender
5,937,444 A 8/1999 Hochmuth
5,946,720 A 9/1999 Sauriol
5,963,985 A 10/1999 Behr et al.
5,974,588 A 11/1999 Furman
5,983,396 A 11/1999 Morrow et al.
6,012,170 A 1/2000 Kim
6,024,712 A * 2/2000 Iglesias et al. ..... 602/6
6,029,376 A 2/2000 Cass
6,083,184 A 7/2000 Kenosh
6,112,434 A * 9/2000 Seltzer et al. ..... 36/115
6,223,350 B1 5/2001 McFarlane
6,342,043 B1 * 1/2002 Gottsmann et al. ..... 602/12

* cited by examiner

UNIDIRECTIONAL SUPPORT DEVICE

TECHNICAL FIELD

The invention generally relates to support devices for protecting flexural joints of a human body. In particular, the invention relates to unidirectional support devices that are flexible in one direction and substantially rigid in an opposing direction.

BACKGROUND INFORMATION

Various athletic maneuvers can create extreme forces upon various flexural joints of the human body, such as the ankle, knee, hip, back, neck, shoulder, elbow, wrist, fingers, or thumb. For example, playing basketball and tennis often results in extreme forces being translated along a lateral plane of the ankle/foot and shoe. The lateral force can cause the shoe to articulate on the lateral plane, allowing the ankle to over-invert, which in turn may cause an inversion sprain. The flexural joints of the human body are also subjected to extreme forces in contact sports. For example, a soccer goalkeeper's hands and wrists are exposed to extreme forces when catching or blocking a ball. Such forces can result in the goalkeeper's hands bending backwards, hyperextending the goalkeeper's fingers, thumb, and/or wrists. Inversion, eversion, or hyperextension of the body's flexural joints can cause traumatic damage to the flexural joints.

The risk of inversion, eversion, or hyperextension, and the resulting injury, can be reduced by restricting the motion of the joint. Known methods for attempting to reduce the aforementioned risk include taping the joint or positioning a support device about the joint. Taping the joint of an athlete is a time-consuming and relatively expensive procedure, which generally can not be performed by the athlete. Taping typically needs to be done by an athletic trainer or other person with specialized knowledge to properly and effectively tape the joint.

Support devices are available in a variety of configurations, most of which incorporate rigid members, elastic materials, and/or straps. Such devices, while potentially offering somewhat improved stability, are often uncomfortable and cumbersome, and add extra weight. Moreover, such devices may also restrict the natural range of motion of the joint to an extent that athletic performance is compromised or impeded. For example, a support device sufficiently rigid to restrict the motion of an elbow to prevent hyperextension, i.e., the backward motion of the joint, may also restrict the forward bending of the elbow joint.

SUMMARY OF THE INVENTION

The unidirectional support device of the present invention overcomes the problems found in known methods and devices for preventing injury to flexural joints of the human body. Generally, the unidirectional support device is substantially flexible in one direction, thereby allowing essentially unfettered motion of the joint in that direction, and substantially rigid in an opposing, hyperextension direction, thereby preventing movement of the joint in the opposing direction. Furthermore, the device is lightweight and can be incorporated into many different articles of clothing or sports equipment. The device can also be manufactured in a number of shapes and sizes to suit a variety of applications.

In one aspect, the invention relates to a unidirectional support device. The device includes a generally nonplanar exoskeleton, defining at least one aperture, and a spine including at least one vertebra. The vertebra mates with the aperture, and the exoskeleton remains nonplanar in a loaded state.

In various embodiments, the exoskeleton and spine are flexible in one direction and substantially rigid in an opposing direction when mated. The exoskeleton can include a lip disposed about at least a portion of a perimeter of the exoskeleton. In further embodiments, the device includes an article of sports equipment in which the device is disposed proximate to a flexural joint of a human body when donned. The article of sports equipment can include sports shoes, gloves, shin guards, ankle braces, back braces, knee braces, elbow braces, neck braces, shoulder braces, and hip braces.

In another aspect, the invention relates to an article of sports equipment including a unidirectional support device. The unidirectional support device includes a generally nonplanar exoskeleton, defining at least one aperture, and a spine including at least one vertebra. The vertebra mates with the aperture, and the exoskeleton remains nonplanar in a loaded state. The article of sports equipment can include sports shoes, gloves, shin guards, ankle braces, back braces, knee braces, elbow braces, neck braces, shoulder braces, and hip braces.

In various embodiments of the foregoing aspect of the invention, the device is disposed within a pocket on the article. The device can be secured within the pocket by a hook and loop fastener. The exoskeleton can include a lip disposed about at least a portion of a perimeter of the exoskeleton. The device can be stitched to the article through the lip. Alternatively, the device can be bonded to the article. In additional embodiments, the article can include a second unidirectional support device. The second device includes a second exoskeleton, defining at least one aperture, and a second spine including at least one vertebra. The second vertebra mates with the second aperture. The second exoskeleton can be nonplanar and can remain nonplanar in a loaded state.

In yet another aspect, the invention relates to an article of footwear including an upper, a sole, and a unidirectional support device disposed proximate the ankle of a wearer. The unidirectional support device includes an exoskeleton, defining at least one aperture, and a spine including at least one vertebra. The vertebra mates with the aperture.

In various embodiments of the foregoing aspect of the invention, the device is disposed on the footwear upper. The device can be disposed on a medial or lateral side of the upper, or disposed on the upper in an area corresponding to a wearer's heel. Additionally, the device can be disposed within a pocket in the upper and secured within the pocket by a hook and loop fastener. The exoskeleton can include a lip disposed about at least a portion of a perimeter of the exoskeleton and can be stitched to the upper through the lip. Alternatively, the device can be bonded to the upper. In additional embodiments, the article can include a second unidirectional support device. The second device includes a second exoskeleton defining at least one aperture and a second spine including at least one vertebra. The second vertebra mates with the second aperture. Additionally, one or both of the exoskeletons can be nonplanar.

In various embodiments of the foregoing aspects of the invention, the exoskeleton and spine are secured to each other by frictional engagement or are bonded together. Further, the exoskeleton can define a plurality of apertures predeterminedly spaced in the exoskeleton and the spine can include a plurality of vertebrae spaced on the spine so as to substantially correspond with the apertures in the exoskeleton. The exoskeleton, the spine, or both can be made from a polymer or polymer blend. Additionally, the device can have essentially any shape, such as polygonal, arcuate, or combinations thereof. Also, the device can include a proximal end and a distal end, wherein a width of the distal end is less than a width of the proximal end.

These and other objects, along with advantages and features of the present invention herein disclosed, will become apparent through reference to the following description, the accompanying drawings, and the claims. Furthermore, it is to be understood that the features of the various embodiments described herein are not mutually exclusive and can exist in various combinations and permutations.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention. In the following description, various embodiments of the present invention are described with reference to the following drawings, in which.

DESCRIPTION

Figure 1B:
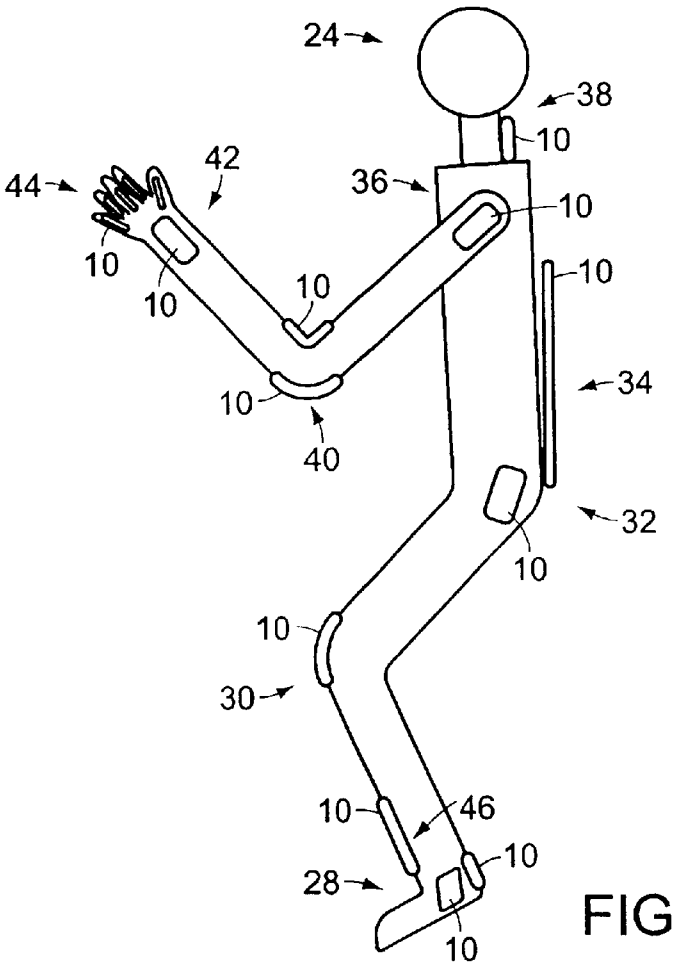
FIG. 1B is a schematic representation of a plurality of unidirectional support devices disposed proximate various flexural joints of a human body.
Figure 1A:
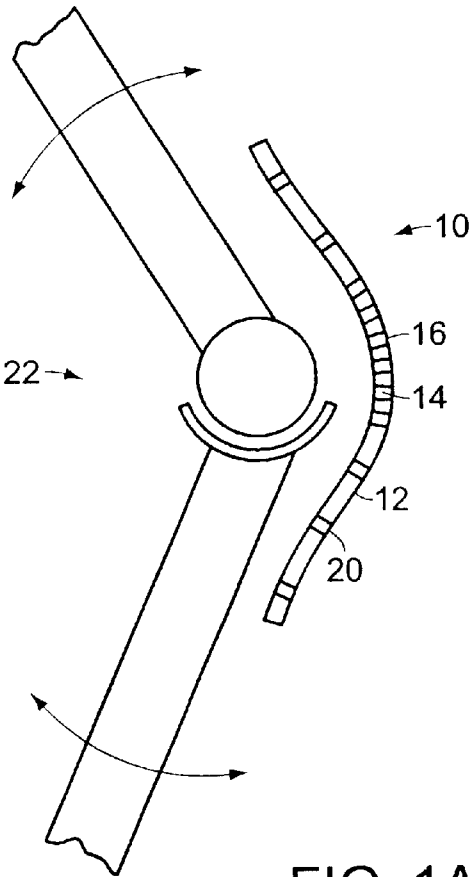
FIG. 1A is a schematic representation of a unidirectional support device in accordance with the invention and disposed proximate a flexural joint.

FIG. 1A depicts one embodiment of a unidirectional support device 10 disposed proximate a flexural joint 22. The device 10 includes an exoskeleton 12 that defines at least one aperture 20 and a spine 14 that includes at least one vertebra 16. The exoskeleton 12 and spine 14 are discussed in greater detail hereinbelow with respect to FIGS. 2–4. The device 10 is preferably disposed proximate a flexural joint 22 of a human body in conjunction with an article of sports equipment or clothing, such as an elbow brace. The device 10 is sufficiently flexible to conform to the form of the joint 22 and permit flexure of the joint throughout its natural range of motion. Also, the device 10 shown here is disposed proximate the exterior region of the joint 22; however, the device 10 can also be located proximate the interior region of the joint 22, or proximate both the exterior and interior regions. In the embodiment shown in FIG. 1A, the device 10 includes a plurality of apertures 20 and a corresponding plurality of vertebrae 16 disposed therein.

FIG. 1B depicts a plurality of devices 10 disposed at various flexural joints 22 of a human body 24. Some examples of where the device 10 can be located include: the neck 38, back 34, hip 32, knee 30, ankle 28, shoulder 36, elbow 40, wrist 42, fingers 44, and shin 46.

Figure 2A:
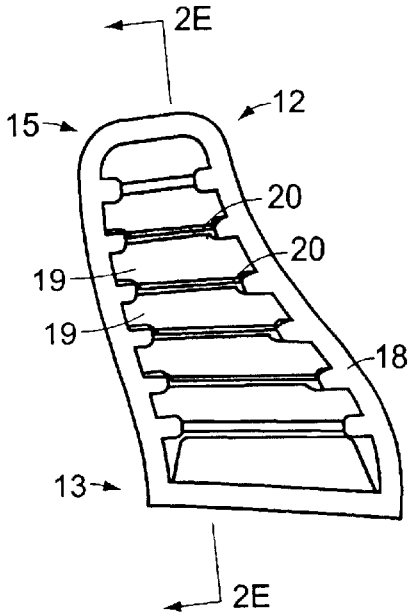
FIGS. 2A–2D are schematic views of the front, back, left, and right sides of one embodiment of an exoskeleton in accordance with the invention.
Figure 2B:
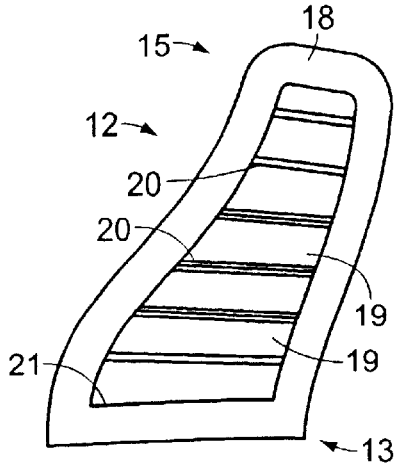
Figure 2C:
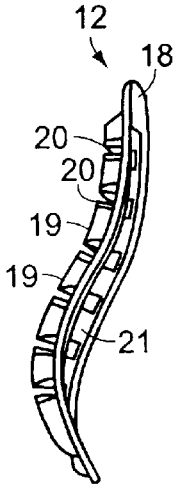
Figure 2D:
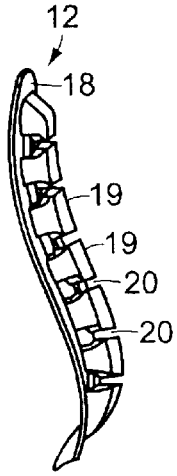

FIGS. 2A–2D depict various views of one embodiment of an exoskeleton 12 in accordance with the invention. Specifically, FIG. 2A depicts the front view of the exoskeleton 12, which includes a lip 18 extending about a periphery of the exoskeleton 12 and at least one aperture 20. In this embodiment, the exoskeleton 12 includes six generally equally spaced apertures 20 and is nonplanar; however, the exoskeleton 12 may include any number/spacing of apertures 20 and may be planar in other embodiments. In addition, FIGS. 2C and 2D depict the left and right side views of the exoskeleton 12, where it can be seen that this particular embodiment of the exoskeleton 12 is complexly contoured in multiple planes. The shape of the exoskeleton 12 is a combination of polygonal and arcuate shapes; however, the shape could be polygonal, arcuate, or any combination thereof. In the present application, the term polygonal is used to denote any shape including at least two line segments, such as rectangles, trapezoids, triangles, etc. The exoskeleton 12 has a proximal end 13 and a distal end 15. In the present embodiment, the width of the distal end 15 is less than the width of the proximal end 13; however, the relationship between the proximal end 13 and distal end 15 will vary according to the shape of the exoskeleton 12 and the flexural joint 22 to be protected. In particular, the size and shape of the device 10 will vary depending on the biophysiology of the flexural joint 22. Further, the device 10 shape and/or size may be chosen to mimic or correspond to the ligaments surrounding the flexural joint 22.

Figure 2E:
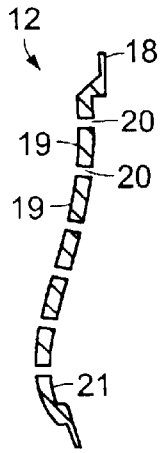
FIG. 2E is a schematic cross-sectional view of the exoskeleton of FIG. 2A taken at line 2E—2E.

In this embodiment, the lip 18 of the exoskeleton 12 runs along the entire perimeter of the exoskeleton 12, but may run only partially along the perimeter in other embodiments. The lip 18 can be used to secure the exoskeleton 12 to an article of sports equipment, for example by stitching through the lip 18 or by bonding the lip 18 to the article. The exoskeleton 12 further includes a series of protuberances 19 that protrude from the front side of the exoskeleton 12. The protuberances 19 help to define the apertures 20 and house a spine within a cavity 21 created by the protuberances 19, as best seen in FIGS. 2B, 2C, and 2E. Additionally, the size and spacing of the protuberances 19 effect the flexibility of the exoskeleton 12. The exoskeleton 12 alone, without the installed spine 14, is substantially flexible in opposing directions, at least through a limited range of flexure. The spine 14 is described in greater detail below, with respect to FIGS. 3A–3E. The operation of the device 10 is described in greater detail below, with respect to FIGS. 4A–4F.

Referring to the cross-section of the exoskeleton 12 in FIG. 2E, the apertures 20 are clearly visible. The size, shape, and spacing of the apertures 20 will vary for any particular application. Specifically, spacing can be varied to accommodate the application or the body part supported. For example, the flexibility/rigidity can be greater when the apertures 20 are closer together. The apertures 20 need not be equally spaced. Spacing can be varied along the exoskeleton 12. For example, the apertures 20 can be located closer together in an area corresponding to a flexural joint 22 and spaced further apart in the areas furthest from the joint 22. Such an arrangement can be seen in FIG. 1A, where the apertures 20 are closely spaced in the area around the joint for maximum flexibility in one direction and maximum rigidity in the opposing direction. The aperture 20 spacing at the ends of the device 10, i.e., the areas furthest from the joint 22, is greater, because these areas do not require the same degree of rigid support or flexibility for bending.

The exoskeleton 12 can be manufactured by, for example, injection molding or extrusion. Extrusion processes may be used to provide a uniform shape, such as a single monolithic frame. Insert molding can then be used to provide the desired geometry of the open spaces, or the open spaces could be created in the desired locations by a subsequent machining operation. Other manufacturing techniques include melting or bonding additional portions. For example, the protuberances 19 may be adhered to an exoskeleton perimeter frame with a liquid epoxy or a hot melt adhesive, such as ethylene vinyl acetate (EVA). In addition to adhesive bonding, portions can be solvent bonded, which entails using a solvent to facilitate fusing of the portions to be added to the frame.

The exoskeleton 12 can be manufactured from any suitable polymeric material or combination of polymeric materials, either with or without reinforcement. Suitable materials include: polyurethanes, such as a thermoplastic polyurethane (TPU); EVA; thermoplastic polyether block amides, such as the Pebax® brand sold by Elf Atochem; thermoplastic polyester elastomers, such as the Hytrel® brand sold by DuPont; nylons, such as nylon 12, which may include 10 to 30 percent or more glass fiber reinforcement; silicones; polyethylenes; and equivalent materials. Reinforcement, if used, may be by inclusion of glass or carbon graphite fibers or para-aramid fibers, such as the Kevlar® brand sold by DuPont, or other similar method. Material hardness is within the range of about 10 and about 100 Shore D, preferably between about 40 and about 80 Shore D, and most preferably about 60 Shore D. Also, the polymeric materials may be used in combination with other materials, for example rubber. Other suitable materials will be apparent to those skilled in the art.

Figure 3A:
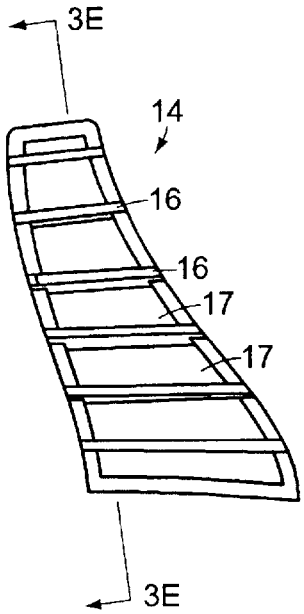
FIGS. 3A–3D are schematic views of the front, back, left, and right sides of one embodiment of a spine in accordance with the invention.
Figure 3B:
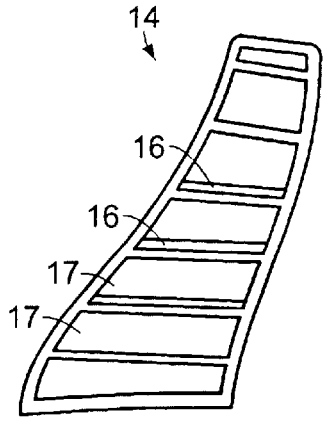
Figure 3C:
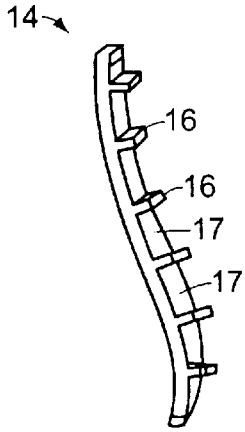
Figure 3D:
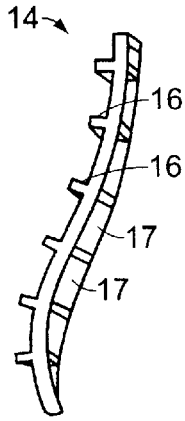
Figure 3E:
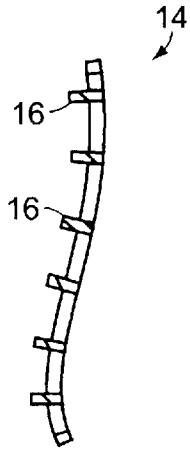
FIG. 3E is a schematic cross-sectional view of the spine of FIG. 3A taken at line 3E—3E.

FIGS. 3A–3D depict the various views of one embodiment of a spine 14 in accordance with the invention. Specifically, FIG. 3A depicts the front view of the spine 14, which includes at least one vertebra 16. In this embodiment, the spine 14 includes six generally equally spaced vertebrae 16, the number and spacing of which correspond substantially to the six apertures 20 present in the exoskeleton 12. The spine 14 is substantially flexible so as to conform to the contour of the exoskeleton 12, and may be planar or nonplanar. The size and shape of the spine 14 is dictated by the exoskeleton 12 with which it mates. In the embodiment shown in FIGS. 3A–D, the shape of the spine 14 is a combination of polygonal and arcuate shapes. As with the exoskeleton 12, the shape could be polygonal, arcuate, or any combination thereof.

FIGS. 3A–3E further depict the vertebrae 16 flush with the back side of the spine 14 and protruding from the front face of the spine 14; however, the configuration of the vertebrae 16 are not limited in this regard. The vertebrae 16 may be flush, protruding, or any combination thereof with respect to the front and/or back face of the spine 14. Further, the spine 14 and vertebrae 16 define a series of gaps 17 between the vertebrae 16. The gaps 17 may be open spaces or filled with material, i.e., the spine 14 can be a frame or a solid surface; however, the use of the gaps 17 avoid unnecessary weight.

Like the exoskeleton 12, the spine 14 can also be manufactured by injection molding or extrusion and optionally a combination of subsequent machining operations, for example, melting or otherwise adhering portions, such as the vertebrae 16 to the spine 14. The spine 14 can be manufactured from the same materials as the exoskeleton 12, as discussed hereinabove.

FIGS. 4A–4D depict the various views of one embodiment of the device 10, which includes an exoskeleton 12 and a spine 14 mated in accordance with the invention. The spine 14 is disposed within a cavity 21 that is defined by the lip 18 and protuberances 19 of the exoskeleton 12. The spine 14 is retained in the exoskeleton 12 by frictional engagement and/or an interference fit. The spine 14 can be sized and configured so that the spine 14 snaps into the cavity 21 in the exoskeleton 12. Alternatively, the spine 14 may be held in place by adhesive bonding, solvent bonding, mechanical retention, or similar techniques.

Figure 4A:
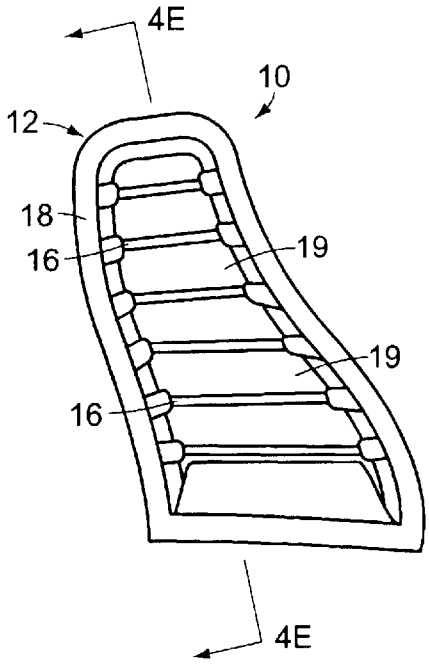
FIGS. 4A–4D are schematic views of the front, back, left, and right sides of a unidirectional support device in accordance with the invention.
Figure 4B:
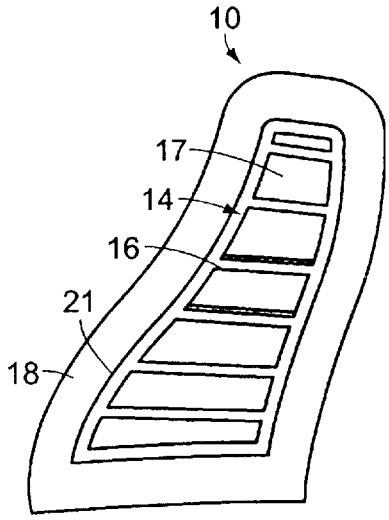
Figure 4C:
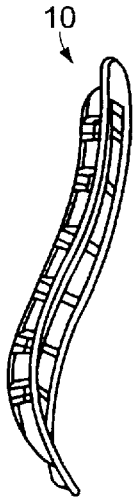
Figure 4D:
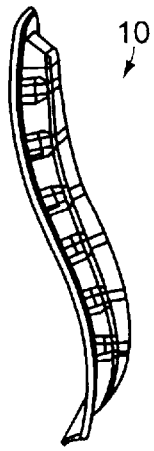
Figure 4E:
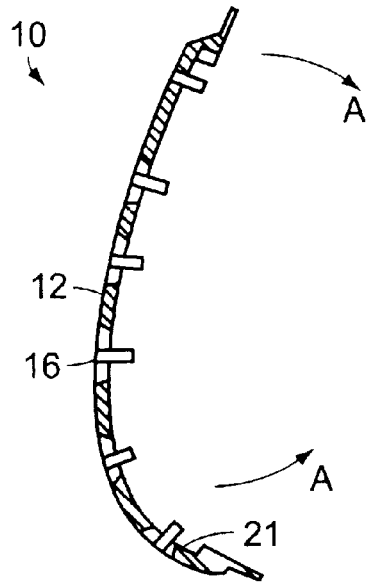
FIG. 4E is a schematic cross-sectional view of the device of FIG. 4A taken at line 4E—4E, and depicting the device in a flexed state.

From an unloaded rest position, the device 10 is substantially flexible in one bending direction, which is depicted by the arrows labeled "A" in FIG. 4E. Specifically, the device can flex in the direction of the spine 12 or cavity 21. During flexing, the protuberances 19 spread apart, thereby allowing the apertures 20 to open. No significant resistance to bending is present. The spacing of the apertures 20 and corresponding vertebrae 16 affect the flexibility of the device 10, insofar as the more closely spaced the apertures 20 and vertebrae 16, the greater the flexibility of the device 10 for a given material and geometry.

Figure 4F:
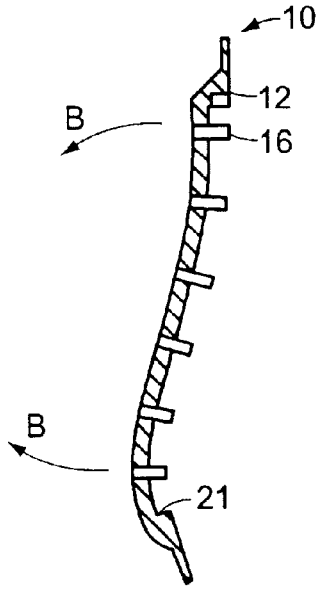
FIG. 4F is a schematic cross-sectional view of the device of FIG. 4A taken at line 4E—4E, and depicting the device in a rigid state.

When the device 10 is loaded, i.e., flexed in the opposing direction, however, there is substantial resistance to bending, as the apertures 20 close on and contact the vertebrae 16. This resistance to flexing allows the device 10 to achieve substantial rigidity, to protect against inversion, eversion, or hyperextension of a flexural joint 22 of a human body 24. During flexing in this direction, which is represented by the arrows labeled "B" in FIG. 4F, the device 10 is loaded. During loading, the protuberances 19 move closer together, thereby reducing the size of the apertures 20, until the vertebrae 16, which are disposed within the apertures 20, contact the protuberances 19 to prevent the apertures 20 from closing completely. This interference effectively prevents the device 10 from flexing further in this direction once contact is made. As can be seen in FIG. 4F, the exoskeleton 12 remains nonplanar in the loaded state.

The rigidity and range of flexing of the device 10 can be customized, for example, by controlling the spacing between the vertebrae 16 and apertures 20. The spacing is a function of the size of the apertures 20 and vertebrae 16, which in turn controls the amount of flexing that can occur in the opposing direction. The exoskeleton 12 will flex only until the apertures 20 contact the vertebrae 16, after which point, no further movement is possible without deformation or compression. Therefore, the lesser the space between the apertures 20 and vertebrae 16, the lesser the range of motion of the device 10 in the opposing direction. In another embodiment, at least the vertebrae 16 of the spine 14 can be at least somewhat compressible relative to the protuberances 19, so as to provide damping.

The device 10, i.e., the exoskeleton 12 and spine 14, can be integrally formed by a process called reverse injection, in which the exoskeleton 12 itself forms the mold for the spine 14. Such a process can be more economical than conventional manufacturing methods, because a separate spine 14 mold is not required. The device 10 can also be formed in a single step called dual injection, where two or more materials of differing densities are injected simultaneously to integrally create the exoskeleton 12 and the spine 14. These processes can also include multiple points of injection for the material for the exoskeleton 12 and the spine 14. The presence of these multi-injection points allows the manufacturer to produce very thin, but supportive structures. This is in contrast to a process with a single point of injection where it is more difficult to create a thin structure, as thin areas of the mold will tend to impede the flow of the viscous injectant into the mold, resulting in incomplete filling, referred to by those of skill in the art as a short shot.

The materials chosen for the exoskeleton 12 and spine 14 can be "compatible." Being compatible means that the exoskeleton 12 and the spine 14 are able to chemically bond to each other at discrete locations, for example, the outer perimeter of the spine 14 and the vertebrae 16, after the process of integrally forming them. It is also desirable that the materials chosen for the exoskeleton 12 and the spine 14 have similar limit radii. A limit radius is known in the art as the minimum radius of curvature of a length of material when a moment is applied to bend the material, without destroying the integrity of the material. Because the device 10 typically undergoes numerous instances of bending and twisting when in use, an exoskeleton 12 with a limit radius that is sufficiently different from the limit radius of the spine 14 could potentially cause the exoskeleton 12 and spine 14 to separate, because one material would have a greater resistance to bending than the other. In other words, the greater resistance of one material can cause the two materials to be in tension with each other and, thus can potentially destroy the bond between the exoskeleton 12 and spine 14.

Figure 5:
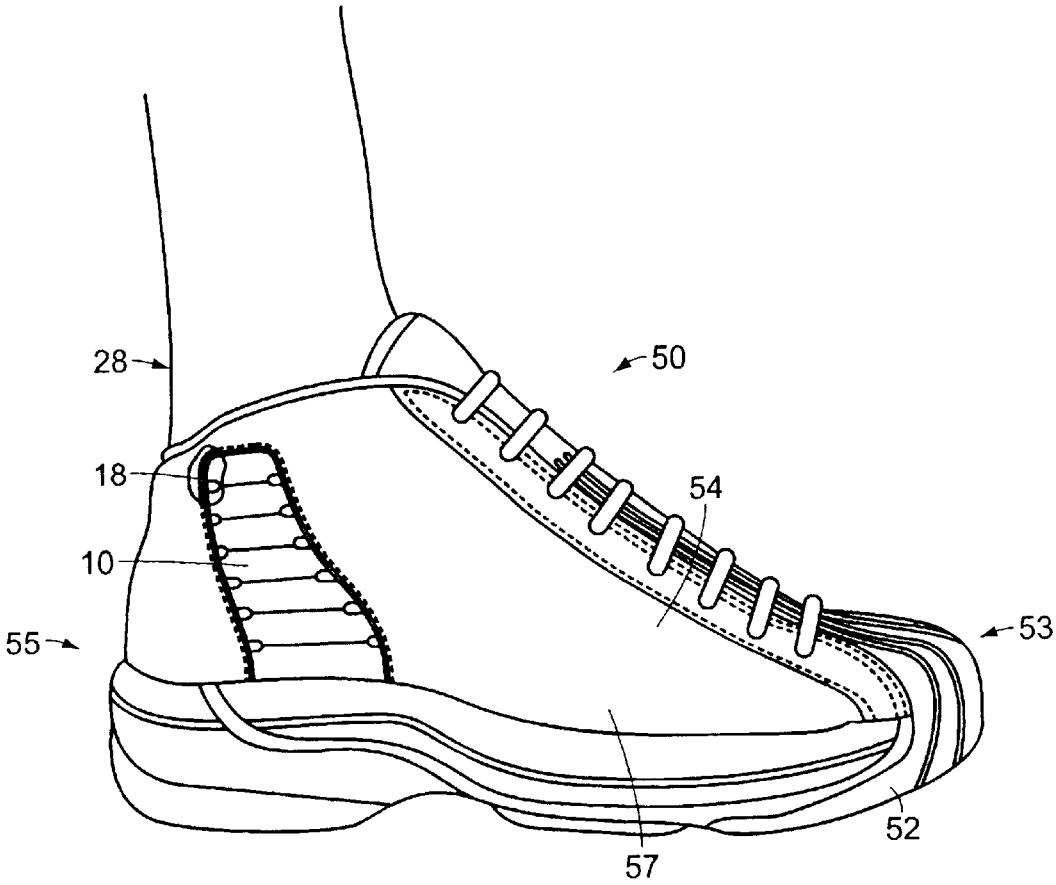
FIG. 5 is a schematic view of a medial side of an article of footwear including an embodiment of a unidirectional support device in accordance with the invention.

FIG. 5 depicts the device 10 incorporated into a sports shoe 50; however, the device 10 could be incorporated into essentially any article of footwear. The shoe 50 includes an upper 54 and a sole 52. In this embodiment, the device 10 is stitched to the upper 54 so that the device 10 is visible. Alternatively, the device could be bonded to the upper 54 or secured within a pocket in the upper 54. A pocket for holding the device 10 is shown and described in conjunction with an embodiment of the invention depicted in FIG. 9.

Figure 8:
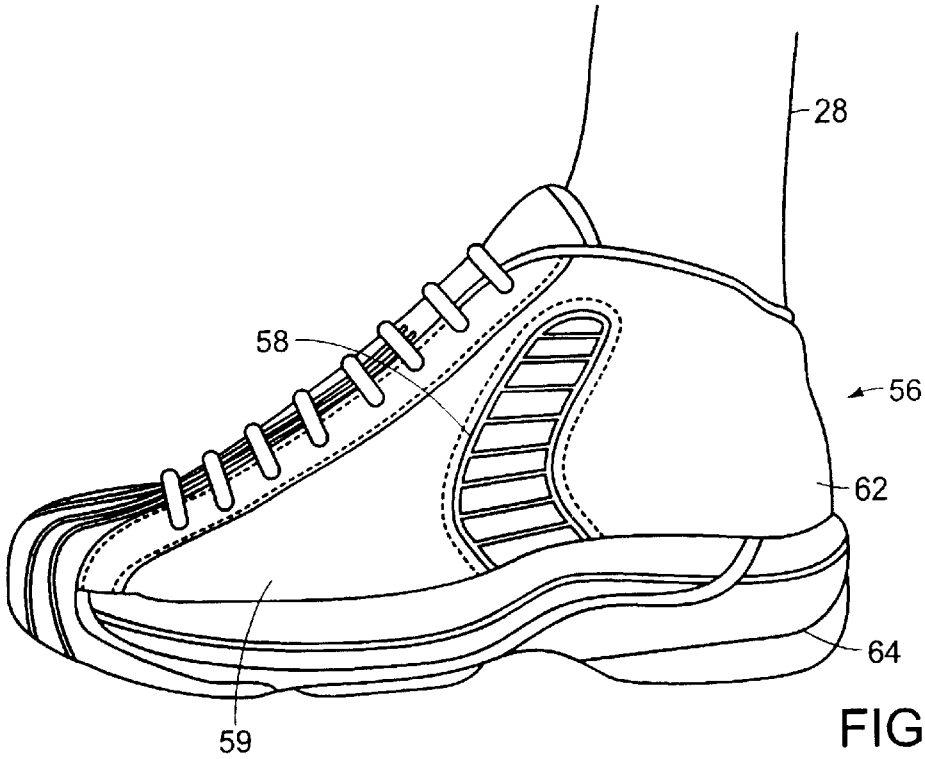
FIG. 8 is a schematic view of a lateral side of an article of footwear including another embodiment of a unidirectional support device in accordance with the invention.

In the embodiment shown in FIG. 5, the device 10 is located on the medial side 57 of the shoe 50 in the area of a wearer's ankle 28 (also known as the rear quarter panel); however, the device 10 could be located on the lateral side 59 (as shown in FIG. 8) and/or located in an area of the shoe 50 corresponding to a wearer's heel 55 or forefoot 53. In an embodiment having the device 10 located in the area corresponding to a wearer's heel 55, the device 10 can be integrated into or replace a conventional heel counter. Further, the shoe 50 can include multiple devices 10 located at various areas of the shoe 50. In addition, the device 10 can overlap with the sole 52, or otherwise be secured to the sole 52.

In this embodiment, the device 10 is stitched to the shoe 50 through the lip 18. The stitching is consistent with any number of known methods of stitching, in particular those methods for stitching nonfabric or heavy materials. Alternatively, the device 10 can be bonded to the shoe 50 by any of the means discussed hereinabove. The device 10 is oriented such that the spine side of the device 10 is closest to the flexural joint 22, in this case the ankle 28. The orientation of the device 10 on the article determines the direction of flexibility of the device 10. In the example shown in FIG. 5, the device 10 is disposed on the medial side 57 of a shoe 50 with the spine side closest to the ankle 28, which allows the ankle 28 to articulate towards the lateral side 59 (not shown), but not the medial side 57.

Figure 6A:
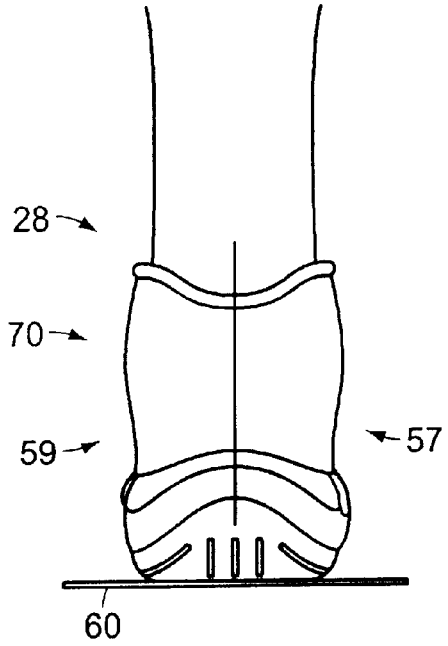
FIGS. 6A–6B are schematic rear views of a wearer's ankle and a shoe in a rest state and an active state.
Figure 6B:
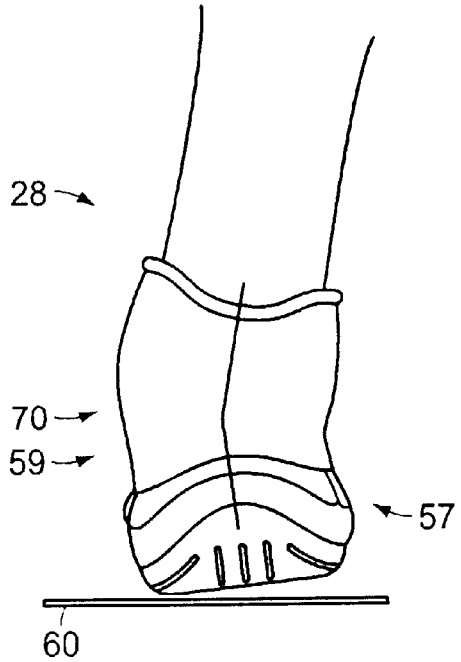

The performance characteristics of an ankle and a conventional shoe without a device 10 are depicted in FIGS. 6A–6B. In FIG. 6A, the ankle 28 and shoe 70 are in a rest state on a planar surface 60. During use, i.e., in an active state, the ankle 28 and shoe 70 are subjected to a variety of forces, one example of which is depicted in FIG. 6B. In FIG. 6B, the ankle 28 and shoe 70 are in an inverted state. Inversion is the rolling of the ankle 28 and shoe 70 to the medial side 57, i.e., rolling inwards. Inversion occurs when the shoe 70 articulates on the lateral plane, allowing the ankle 28 to over-invert, which can cause excessive strain and damage to the wearer, such as an inversion sprain. An inversion sprain occurs when the foot is forced beyond its ligamentous or muscular control and failure of the involved ligaments occurs. Alternatively, eversion may occur, where the ankle 28 and shoe 70 roll to the lateral side 59, i.e. roll outwards. Typically, eversion sprains occur far less frequently than inversion sprains.

Figure 7C:
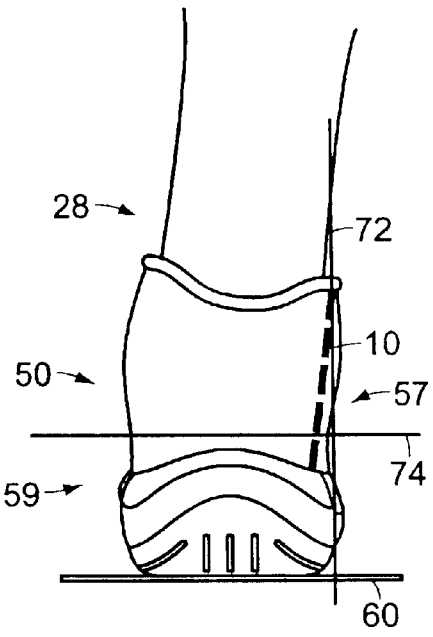
FIGS. 7A–7C are schematic rear views of a wearer's ankle and a shoe in various states, the shoe including an embodiment of a unidirectional support device in accordance with the invention.
Figure 7B:
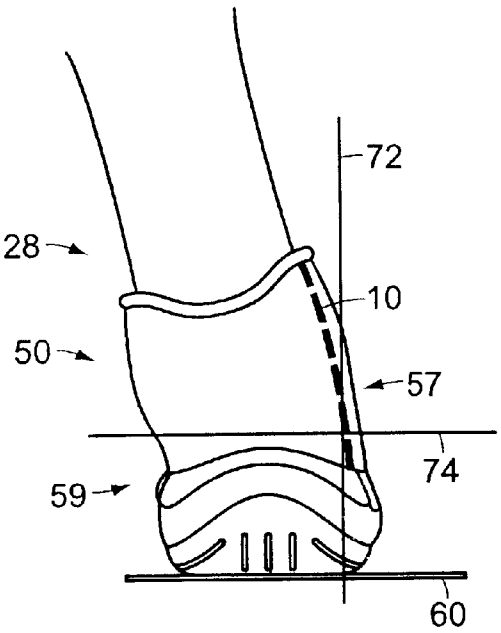
Figure 7A:
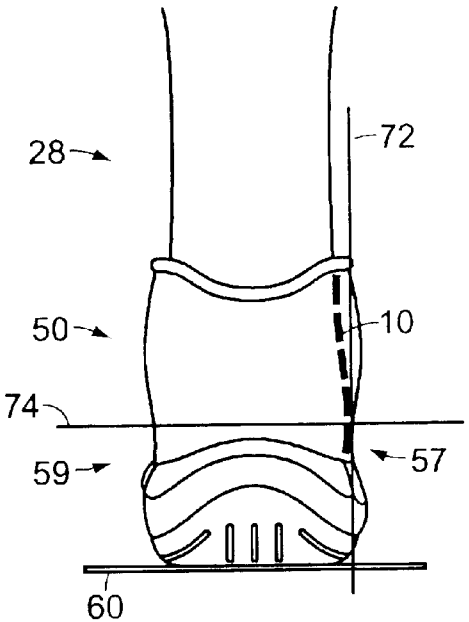

FIGS. 7A–7C depict the performance characteristics of an ankle and a shoe with a device 10 in accordance with the present invention. In FIG. 7A, the ankle 28 and shoe 50 are in a rest state. The device 10 is secured to the medial side 57 of the shoe 50 and is generally oriented along the vertical axis 72. In FIG. 7B, the ankle 28 is articulated to the lateral side 59 of the shoe 50. The device 10 is flexible in the lateral direction, thus allowing free movement of the ankle 28 in the lateral direction. In FIG. 7C, however, the device 10 is rigid in the medial direction, i.e., the device 10 prevents the ankle from articulating to the medial side 57 of the shoe 50. As such, the device 10 substantially reduces and effectively eliminates the possibility of over-inverting the ankle 28.

In alternative embodiments, the device 10 can be positioned on the lateral side 59 of the shoe 50, for example as shown in FIG. 8. The alternative embodiment shown in FIG. 8 includes a device 58 attached to an upper 62 of a shoe 56 including a sole 64. The device 58 is similar in nature to device 10 described above, and can be attached to the shoe 56 by any of the means discussed herein with respect to device 10. In this particular embodiment, the device 58 is disposed slightly forward of the joint and orientated with the spine side furthest from the joint. This particular orientation inhibits movement of the ankle 28 to the medial side 57. Alternatively, the device 58 could be oriented with its spine side closest to the joint 22, in which case, the device 58 would inhibit movement of the ankle 28 to the lateral side 59. Also, the shoe 56 could include a plurality of the devices 10, 58. For example, one device 10 can be disposed on the medial side 57 and one device 58 can be disposed on the lateral side 59. In such an embodiment, the devices 10, 58 can have parallel orientations, i.e., the devices are rigid in the same bending direction.

Figure 9:
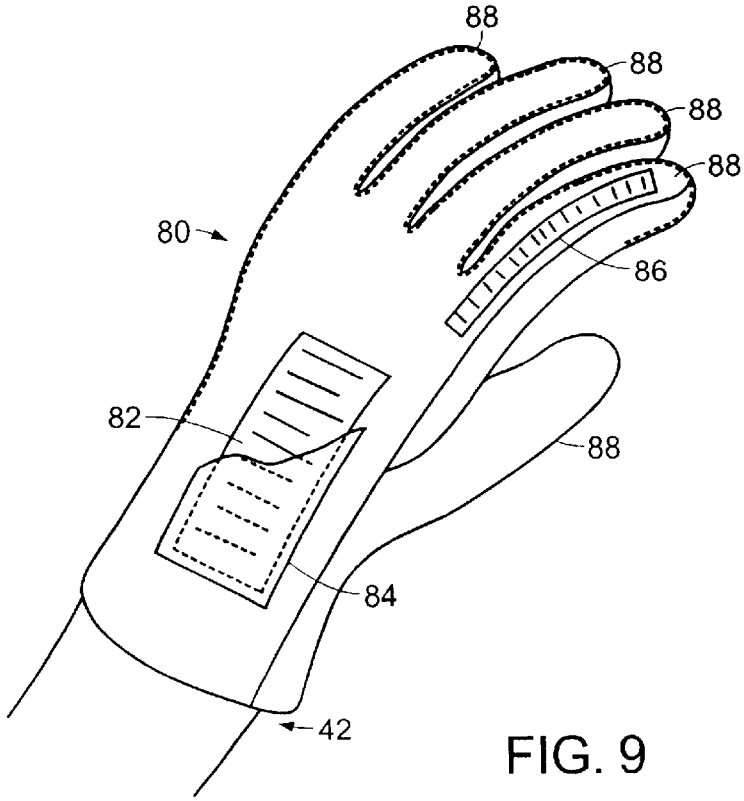
FIG. 9 is a perspective view of a glove including other embodiments of unidirectional support devices according to the present invention.

FIG. 9 depicts an alternative embodiment of the device 82 located in a glove 80. The device 82 is similar in nature to device 10 described above, and can be attached to the glove (or other article) 80 by any of the means discussed herein with respect to device 10. In the embodiment shown, the device 82 is disposed within a pocket 84 located on the back of the glove 80 proximate a user's wrist 42, and secured therein by use of a hook and loop type fastener, such as the Velcro® brand sold by Velcro Industries B.V. The pocket 84 can be stitched or bonded to the glove 80 by any of the methods described herein. Alternatively, the device could be disposed on the palm side of the glove and/or could be attached to the glove 80 by stitching or bonding, as discussed hereinabove.

In this embodiment, the spine side is oriented so as to be closest to the wrist 42 when the glove 80 is worn; however, the device 82 could be oriented in the opposite direction. With the device 82 oriented with the spine side closest to the wrist 42, the device 82 aides in the prevention of hyperextension of the wrist 42. Additionally, devices 86 could be disposed in one or more of the finger portions 88 of the glove 80, along one or more of each finger's joints.

Having described certain embodiments of the invention, it will be apparent to those of ordinary skill in the art that other embodiments incorporating the concepts disclosed herein may be used without departing from the spirit and scope of the invention. The described embodiments are to be considered in all respects as only illustrative and not restrictive.

What is claimed is:

1. An article of footwear including an upper, a sole, and a unidirectional support device, the unidirectional support device comprising:

an exoskeleton defining at least one aperture; and a spine including at least one vertebra, wherein the vertebra mates with the aperture such that the aperture opens when the exoskeleton is flexed in a first direction and closes on and contacts the at least one vertebra when the exoskeleton is flexed in a second opposing direction, such that the device is flexible in the first direction and substantially rigid in the second opposing direction upon contact between the at least one vertebra and the exoskeleton.

2. The article of footwear of claim 1, wherein the exoskeleton and spine are secured by frictional engagement.

3. The article of footwear of claim 1, wherein the exoskeleton and spine are bonded together.

4. The article of footwear of claim 1, wherein a shape of the device is selected from the group consisting of polygonal, arcuate, and combinations thereof.

5. The article of footwear of claim 1, wherein the device includes a proximal end and a distal end and a width of the distal end is less than a width of the proximal end.

6. The article of footwear of claim 1, wherein the exoskeleton is substantially nonplanar in a loaded state.

7. The article of footwear of claim 1, wherein the exoskeleton defines a plurality of apertures predeterminedly spaced in the exoskeleton and the spine includes a plurality of vertebrae spaced on the spine to substantially correspond with the apertures in the exoskeleton.

8. The article of footwear of claim 1, wherein the exoskeleton comprises a polymer.

9. The article of footwear of claim 1, wherein the spine comprises a polymer.

10. The article of footwear of claim 1, wherein the device is disposed on the upper.

11. The article of footwear of claim 10, wherein the device is disposed within a pocket on the upper.

12. The article of footwear of claim 11, wherein the device is secured within the pocket by a hook and loop fastener.

13. The article of footwear of claim 10, wherein the device is disposed on a medial side of the upper.

14. The article of footwear of claim 10, wherein the device is disposed on a lateral side of the upper.

15. The article of footwear of claim 10, wherein the device is disposed in an area of the upper corresponding to a wearer's heel.

16. The article of footwear of claim 1, wherein the exoskeleton further comprises a lip disposed about at least a portion of a perimeter of the exoskeleton.

17. The article of footwear of claim 16, wherein the device is stitched to the upper through the lip.

18. The article of footwear of claim 10, wherein the device is bonded to the upper.

19. The article of footwear of claim 1, further comprising a second unidirectional support device comprising:

a second exoskeleton defining at least one aperture; and a second spine including at least one vertebra, wherein the vertebra of the second spine mates with the aperture of the second exoskeleton.

* * * * *